United States Patent [19]

Kaplan et al.

[11] 4,373,901

[45] Feb. 15, 1983

[54] ADJUSTABLE FLAME SPREADER FOR GUN-TYPE POWER GAS BURNER

[75] Inventors: Robert A. Kaplan; Mark A. Reicke; James E. Wellman, all of Fort Wayne, Ind.

[73] Assignee: The Scott & Fetzer Company, Fort Wayne, Ind.

[21] Appl. No.: 225,846

[22] Filed: Jan. 16, 1981

[51] Int. Cl.[3] ..... F23C 5/06

[52] U.S. Cl. ..... 431/186; 431/350

[58] Field of Search ..... 431/265, 347, 350, 171, 431/172, 186, 189, 355, 187

[56] References Cited

U.S. PATENT DOCUMENTS

| | | | |
|---|---|---|---|
| 650,559 | 5/1900 | Jansson | 431/350 |
| 1,563,246 | 11/1925 | Zulver | 431/171 |
| 1,684,991 | 9/1928 | Inglis | 431/189 |
| 2,180,190 | 11/1939 | Baro | 431/350 |
| 2,183,836 | 12/1939 | Gordon | 431/172 |
| 2,220,603 | 11/1940 | Hirtz | 431/350 |
| 2,514,768 | 7/1950 | Kennedy | 431/186 |
| 3,037,550 | 6/1962 | Uschold | 431/186 |
| 3,123,127 | 3/1964 | Willott | 431/186 |
| 3,212,556 | 10/1965 | Johansson | 431/265 |
| 3,225,813 | 12/1965 | Walsh | 431/350 |

*Primary Examiner*—Daniel J. O'Connor

*Attorney, Agent, or Firm*—Gust, Irish, Jeffers & Hoffman

[57] ABSTRACT

A power gas burner includes a plenum having front and rear walls and a side wall. A blast tube is connected to the front wall communicating with the plenum. A blower has its discharge connected to the plenum. An air-gas mixing tube is disposed in the blast tube with its discharge adjacent the distal end thereof and its inlet extending into the plenum, the mixing tube defining a secondary air passage with the blast tube. The mixing tube has an air-admitting opening adjacent its inlet communicating with the plenum. A gas line extends into the inlet of the mixing tube. A spider supports the discharge of the mixing tube and has legs engaging the distal end of the blast tube. A flame spreader disc is spaced from the discharge of the mixing tube, the diameter of the disc being generally equal to the diameter of the mixing tube at its discharge. The disc is mounted on one end of a rod extending through the air passage, the plenum and the rear wall, the rod being adjustably supported for selective longitudinal movement of the disc between a position spaced from the discharge of the mixing tube and a position outwardly from the rear wall for manual adjustment of the disc between the positions thereof. A sleeve on one of the spider legs slideably supports the other end of the rod.

9 Claims, 8 Drawing Figures

ADJUSTABLE FLAME SPREADER FOR GUN-TYPE POWER GAS BURNER

BACKGROUND OF THE INVENTION

1. Field of the Invention

This invention relates generally to gun-type power gas burners, and more particularly to an adjustable flame spreader for such burners.

2. Description of the Prior Art

Two types of gas burners are conventionally provided for firing domestic furnaces, i.e., atmospheric type and power type. Atmospheric burners rely entirely on atmospheric pressure for supplying combustion air to the burner, i.e., atmospheric burners do not incorporate a blower for supplying combustion air whereas, power burners include a blower. Many smaller, domestic hot water and steam furnaces designed for oil burner firing have a shallow combustion chamber and have boiler tubes extending upwardly which are supported by a crownsheet. There has been a trend in recent years to retrofit furnaces originally intended for oil burner firing with gas burners, however, most domestic furnaces originally intended for oil burner firing cannot be fired by a conventional atmospheric gas burner and thus, a power gas burner is required for such conversion.

Power gas burners inherently provide a long-narrow flame which is not suitable for use in a furnace having a shallow combustion chamber. Flame shapers or targets have been provided for atmospheric gas burners for providing the desired flame shape, such as those shown in U.S. Pat. Nos. 3,018,823; 3,077,517 and 2,905,235. However, such burners are of the type intended for converting coal-fired furnaces which have a large combustion chamber with the heat exchanger located thereover to gas and further, do not provide for adjustment of the flame shaping element after installation of the burner, i.e., the burner must be removed in order to adjust the flame shaping element.

The applicant's assignor has in the past manufactured atmospheric conversion gas burners having an angled, fixed target positioned in front of the burner primarily for deflecting the flame upwardly but which does provide some limited spreading of the flame. In common with other prior flame spreaders known to the present applicant, the target employed with that prior atmospheric burner was not adjustable after installation.

The applicant's assignor has also manufactured a gun-type power gas conversion burner having a fixed flame spreader.

Certain gun-type oil burners, such as those shown in U.S. Pat. Nos. 3,799,732; 3,225,813; 3,224,488 and 3,212,556, have employed a cone positioned in front of the blast tube, that shown in U.S. Pat. No. 3,225,813 being externally adjustable; however, the cone employed with a gun-type oil burner, while superficially resembling a gas burner flame spreader or shaper, is employed for an entirely different purpose, i.e., to provide proper mixing of the air and oil in order to secure proper combustion, the shape of the flame being developed by the nozzle angle rather than by the cone.

The combustion chambers of smaller, domestic hot air and steam furnaces originally designed for oil burner firing have a variety of sizes and configurations, i.e., round, square or rectangular and thus, in converting such furnaces to power gas burner firing, it is necessary properly to size and shape the flame for the particular combustion chamber. Therefore, in providing a gun-type power conversion gas burner suitable for use with a wide variety of such furnaces, it is desirable to provide an externally adjustable flame spreader so that the installer can properly size and shape the gas flame to fit the combustion chamber after the burner is installed without the necessity for removing the burner.

SUMMARY OF THE INVENTION

The invention, in its broader aspects, provides an externally adjustable flame spreader for a gun-type power gas burner, including a plenum chamber with spaced front and rear walls joined by a side wall, and an elongated blast tube having spaced distal and proximal ends with the proximal end being connected to the front wall and communicating with the plenum chamber. A blower having an air discharge duct is connected to one of the plenum chamber walls and communicates with the plenum chamber, and an elongated air-gas mixing tube is coaxially disposed in the blast tube and has spaced discharge and inlet ends with the discharge end being adjacent the blast tube distal end and the inlet end extending into the plenum chamber. The mixing tube is circumferentially spaced from the blast tube to define a secondary air passage therewith and the mixing tube has an air admitting opening therein adjacent its inlet end and communicating with the plenum chamber. A gas supply line extends through one of the walls of the plenum chamber and into the inlet end of the mixing tube. The flame spreader member is imperforate and is spaced outwardly from the discharge end of the mixing tube and normal to the axis thereof. The flame spreader is mounted on one end of an elongated element and means are provided for adjustably supporting the other end of the element on one of the plenum chamber walls for selective longitudinal movement of the element and the flame spreader between a first position closely spaced from the discharge end of the mixing tube and a second position spaced outwardly from the first position thereby selectively to adjust the width and length of the flame. The other end of the flame spreader mounting element extending rearwardly out of the rear wall of the plenum chamber for manual adjustment of the element between its two positions. It is accordingly an object of the invention to provide an externally adjustable flame spreader for a gun-type power gas burner.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
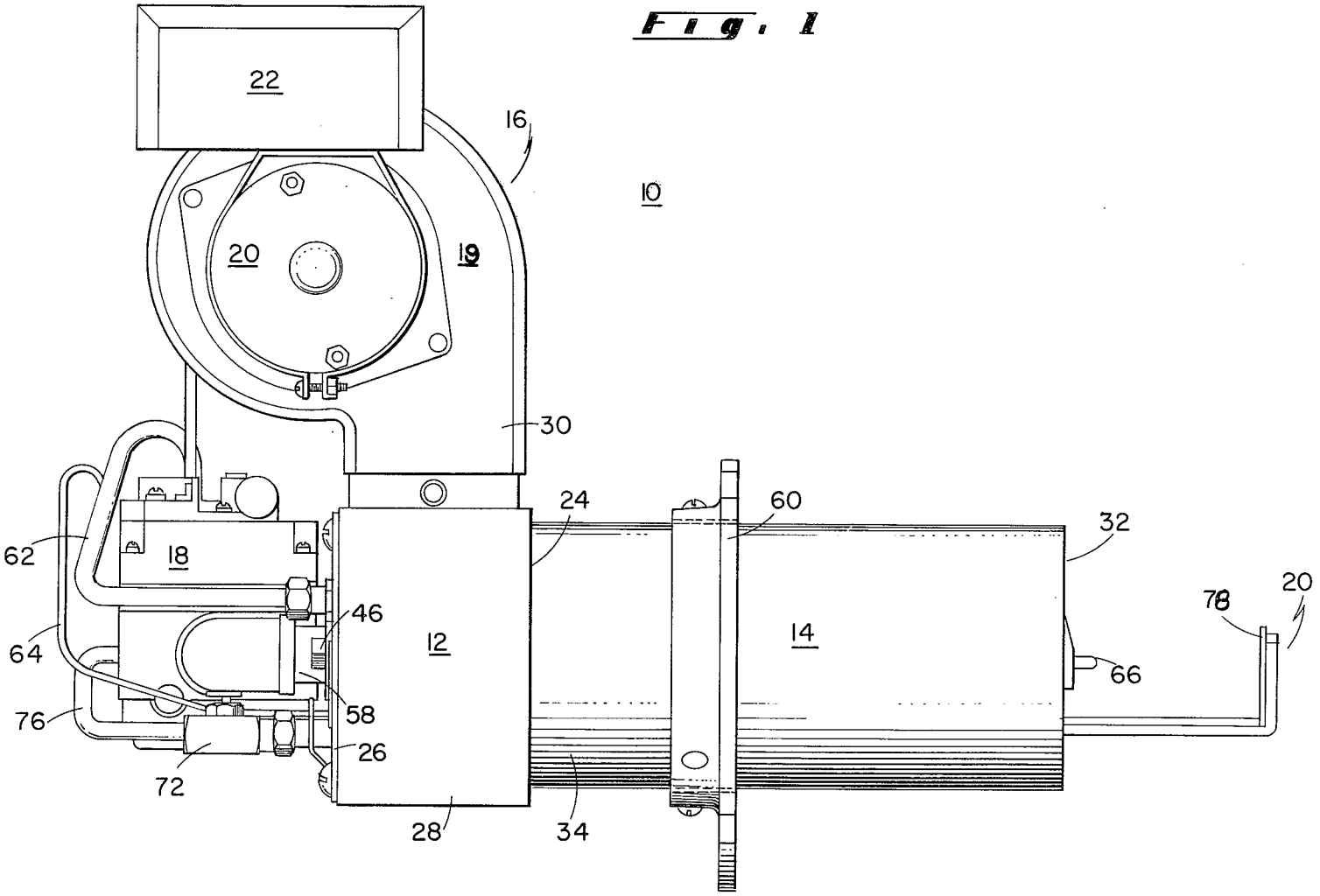
FIG. 1 is a side elevational view of a gun-type power gas burner incorporating the externally adjustable flame spreader of the invention.
Figure 2:
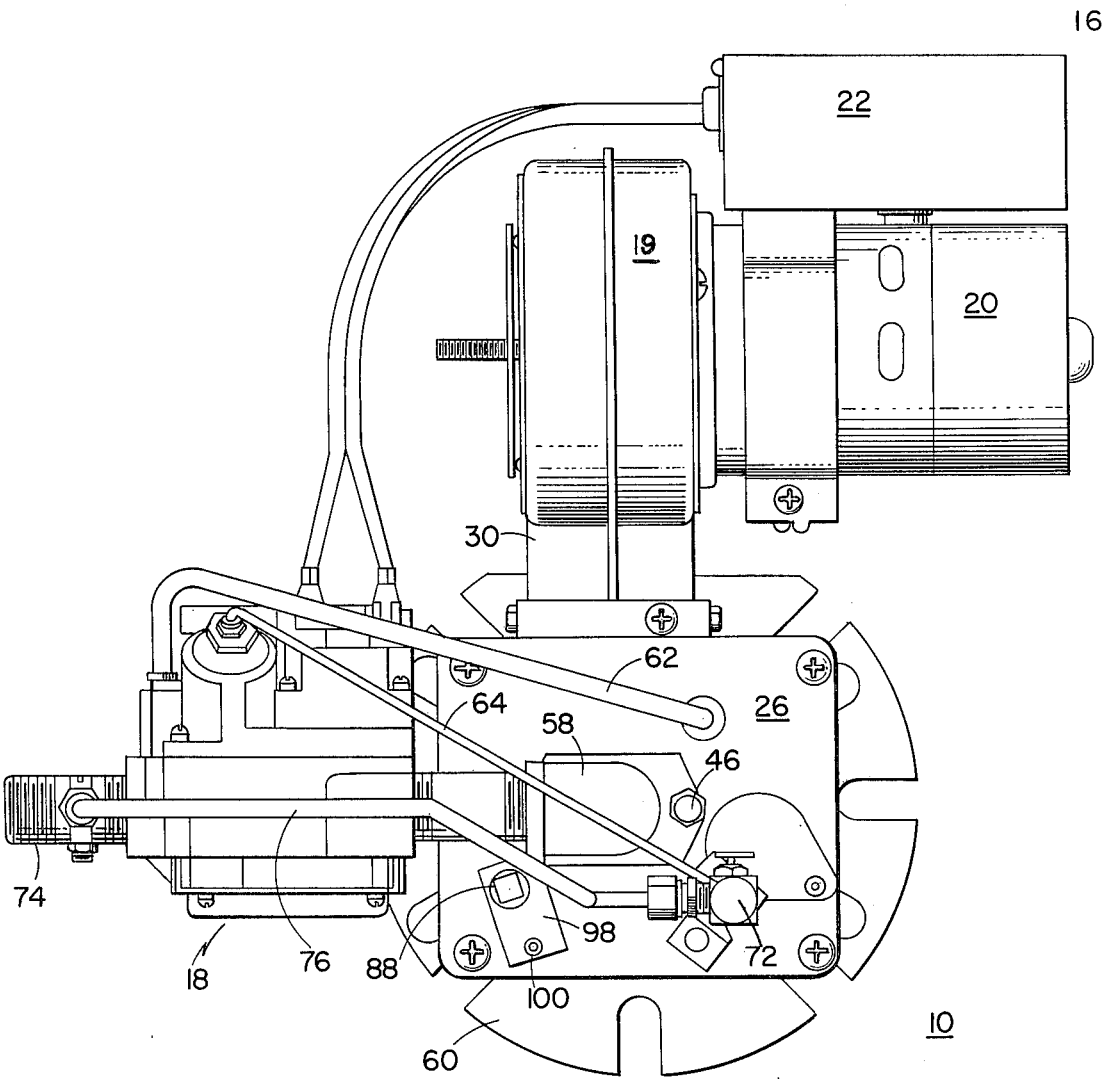
FIG. 2 is a rear elevational view of the burner of FIG. 1.
Figure 3:
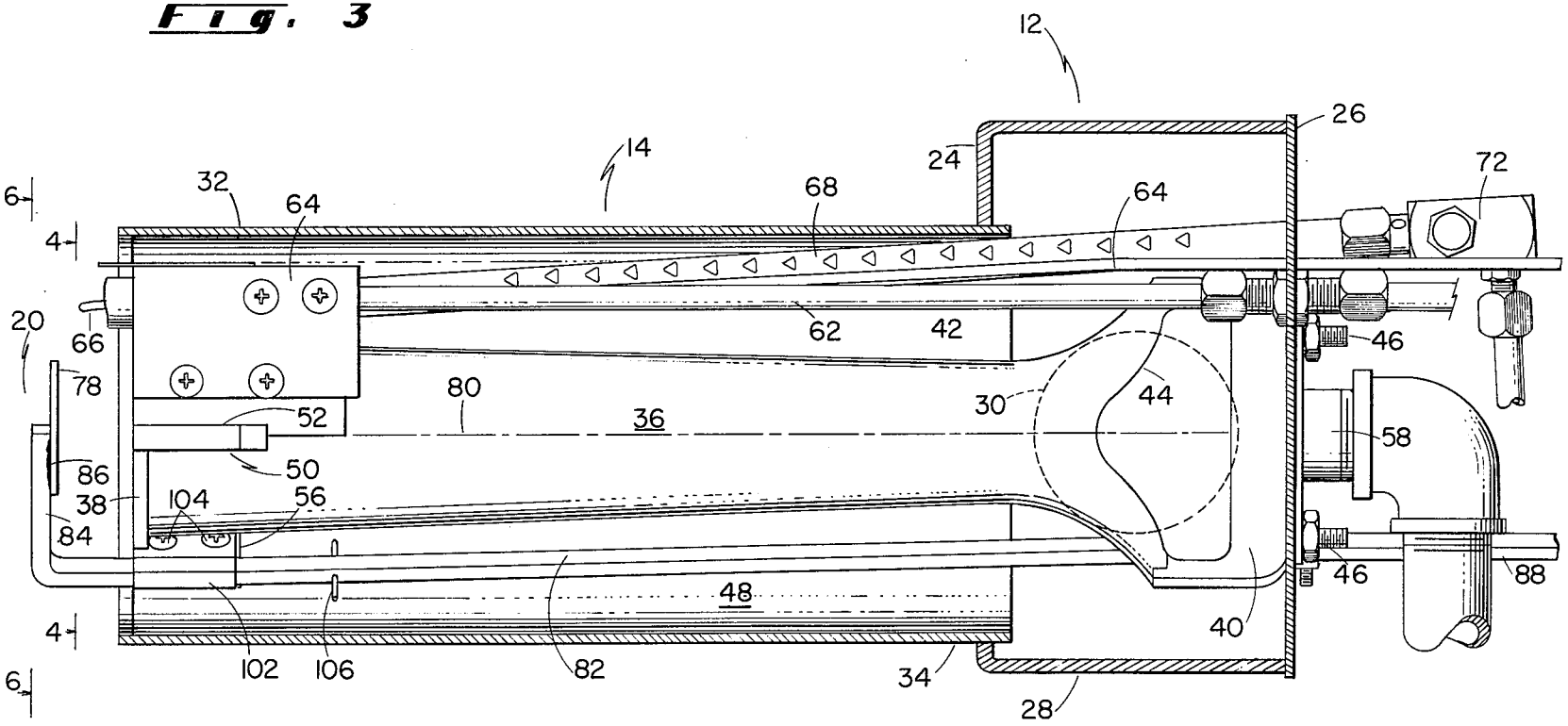
FIG. 3 is a top cross-sectional view of the burner of FIG. 1.
Figure 4:
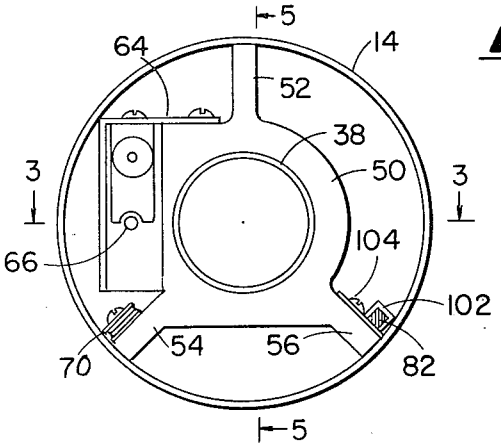
FIG. 4 is a cross-sectional view taken generally along the line 4—4 of FIG. 3.
Figure 5:
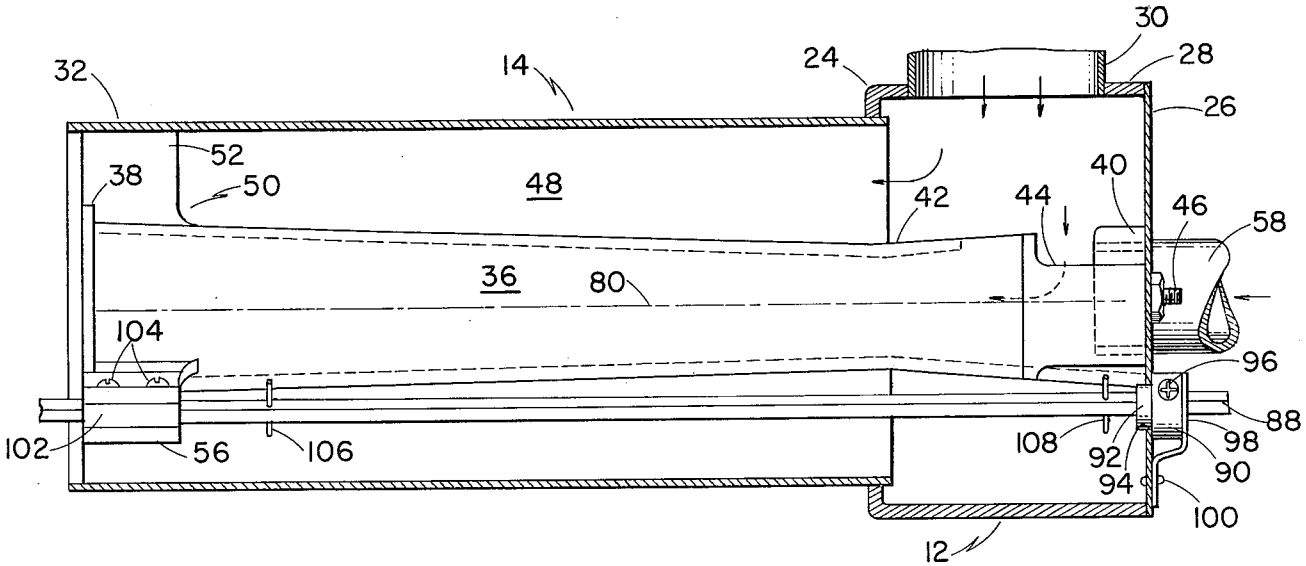
FIG. 5 is a fragmentary side cross-sectional view taken generally along the line 5—5 of FIG. 4.
Figure 6:
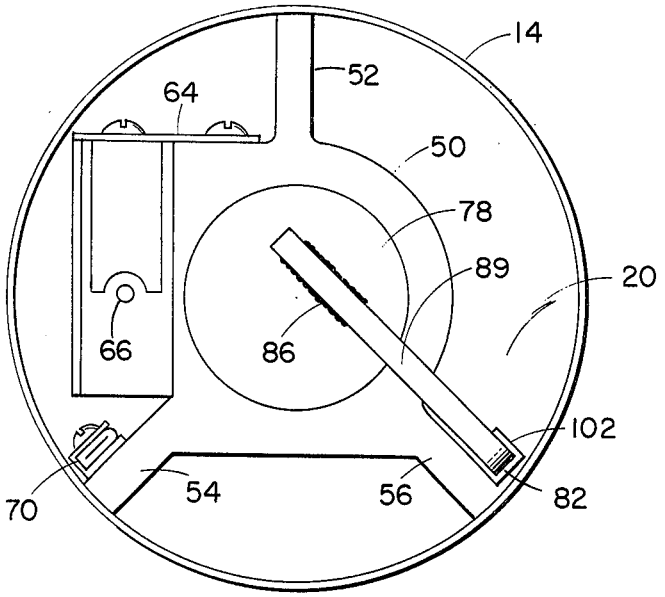
FIG. 6 is a front view taken generally along the line 6—6 of FIG. 3.

Referring now to FIGS. 1 through 6 of the drawings, a gun-type power gas burner is shown, generally indicated at 10, comprising plenum chamber 12, blast tube 14, conventional motor-driven blower assembly 16, conventional gas valve 18, and externally adjustable flame spreader assembly 20. Blower assembly 16 includes conventional squirrel cage blower 18 driven by conventional squirrel cage motor 20. Junction box 22 for making the necessary electrical connections to the burner is mounted on motor 20.

Plenum chamber 12 comprises front and rear walls 24, 26 joined by side wall 28. Blower 18 has air discharge duct 30 connected to side wall 28 and communicating with the interior of plenum chamber 12. Cylindrical blast tube 14 has distal end 32 and proximal end 34 connected to front wall 24 of plenum chamber 12 and communicating therewith.

Air-gas mixing tube 36 is coaxially disposed within blast tube 14 and has discharge end 38 disposed adjacent distal end 32 of blast tube 14 and inlet end 40 extending into plenum chamber 12 and abutting rear wall 26. Air-gas mixing tube 36 is Venturi-shaped providing throat area 42 and has air inlet opening 44 formed in its side wall between throat 42 and inlet end 40 which faces upwardly in general alignment with air discharge duct 30 of blower 18. Inlet end 40 of air-gas mixing tube 36 is secured to rear wall 26 of plenum chamber 12 by suitable threaded fasteners 46. Air-gas mixing tube 36 is circumferentially spaced from blast tube 14 to define secondary air passage 48 therewith.

Discharge end 36 of air-gas mixing tube 36 is supported within distal end 32 of blast tube 14 by spider member 50 having radially spaced leg portions 52, 54, 56 extending outwardly and engaging the inner surface of distal end 32 of blast tube 14. Gas line 58 extends through an opening in rear wall 26 and is threaded in an opening in inlet end 40 of air-gas mixing tube 36.

Conventional mounting flange 60 is adjustably attached to blast tube 14. Pilot gas line 62 extends through air passage 48 terminating at one end at a conventional pilot nozzle attached to spider member 50 by bracket 64. Pilot gas line 62 extends through an opening in rear wall 26 and has its other end connected to gas valve 18. Flame detector thermal couple 64 also extends through passage 48 and has its sensing end 66 projecting forwardly of distal end 32 of blast tube 14. Flame detector thermalcouple tube 64 extends through an opening in rear wall 26 and has its other end coupled to gas valve 18. Flame runner tube 68 extends through air passage 48 and has its front end 70 secured to leg 54 of spider member 50. Runner gas line 68 extends through an opening in rear wall 26 and is coupled to starter gas valve 72 which, in turn, is coupled to input gas line 74 by line 76.

The gun-type power gas burner above-described is conventional and does not form a part of the present invention.

Figure 7:
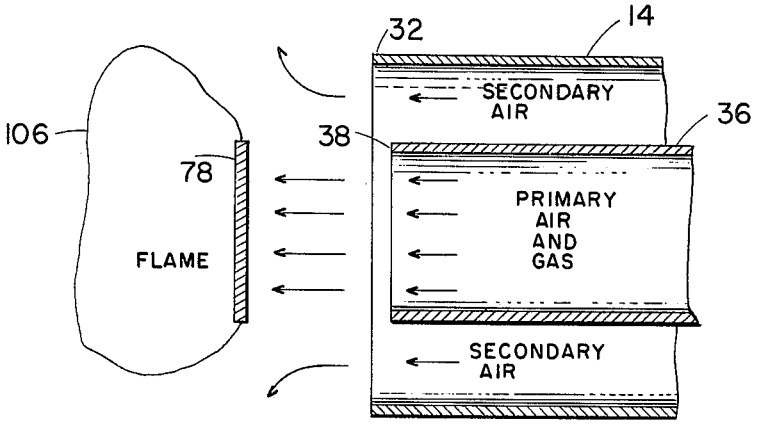
FIG. 7 is a schematic view showing the flame shaping action of the flame shaper of the invention in its first position most closely spaced from the discharge end of the air-gas mixing tube.
Figure 8:
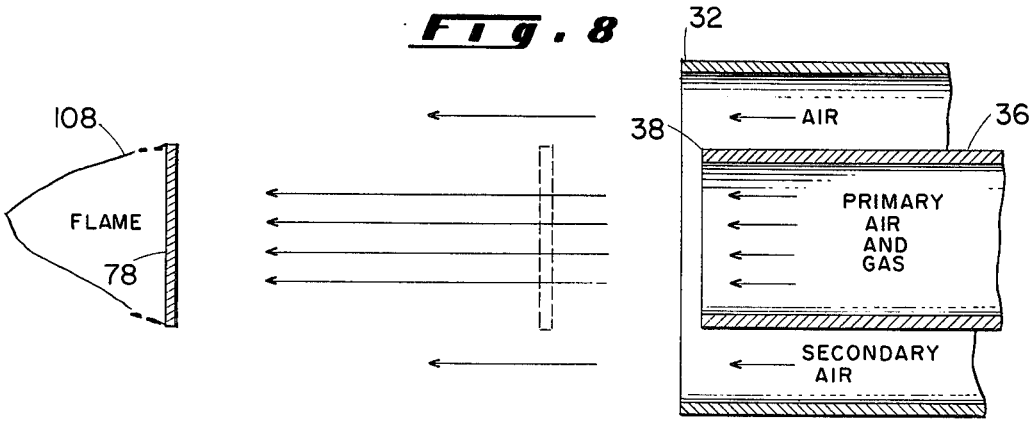
FIG. 8 is a schematic view showing the action of the flame spreader in its second position spaced outwardly from its first position.

In accordance with the invention, flame spreader assembly 20 comprises flat, imperforate flame spreader disc 78 formed of suitable material, such as stainless steel. In the preferred embodiment, the diameter of flame spreader disc 78 is substantially the same as the inside diameter of air-gas mixing tube 36 at its discharge end 38. Flame spreader disc 76 is supported coaxially with axis 80 of air-gas mixing tube 36 and blast tube 14 and in a plane substantially normal thereto by elongated rod element 82. End 84 of rod 82 has a right-angle bend formed therein and flame spreading disc 78 is secured thereto, as by welding at 86. End 88 of rod element 82 extends through bushing 90 having a reduced diameter portion 92 seated in opening 94 in rear wall 26 of plenum chamber 12 and end 88 projects rearwardly from rear wall 26 in order to permit manual adjustment of rod element 82 and flame spreading disc 78 from a first position closely spaced from discharge end 38 of air-gas mixing tube 36, as shown in FIG. 7 to a second position spaced forwardly from the first position, as shown in FIG. 8. Rod element 82 is maintained in the selected position by means of set screw 96 in bushing 90. Bushing 90 is retained by keeper member 98, secured to rear wall 26, as by rivet 100.

Rod element 82 is supported adjacent its front end 84 by means of sleeve 102 secured to leg 56 of spider member 50 by suitable threaded fasteners 104. The first and second positions of rod element 84 and flame spreader disc 78 are determined by limit stop pins 106, 108 seated in openings in rod element 82 between leg 56 and bushing portion 92.

It will be understood that adjustment of the position of the flame spreader 76 changes the static pressure in back of the spreader disc 76, the static pressure in back of the spreader disc 76 being reduced as the spacing of the disc from discharge end 38 of air-gas mixing tube 36 increases. Thus, with the disc 76 in its first position closely spaced from discharge end 38 of air-gas mixing tube 36 and distal end 32 of blast tube 14, as shown in FIG. 7, a short, wide flame is provided, as shown at 106 whereas, with disc 76 in its second, outer position as shown in FIG. 8, a longer, narrower flame is provided as shown at 108.

It will now be seen that by reason of the provision of the externally adjustable flame spreader, it is possible for the installer selectively to adjust the size and shape of the gas flame to fit the particular combustion chamber in which burner 10 is installed after installation of the burner and without removal of the burner from the furnace.

In a specific embodiment of the invention installed on a gun-type power gas conversion burner having minimum input of 50,000 BTU and maximum input of 250,000 BTU for installation in a furnace having a combustion chamber having minimum dimensions of seven inches wide, eight inches long, seven inches high or eight inches round, and having a blast tube 14 four inches in diameter and eight and one-eighth inches long, flame spreader disc 78 was one and one-half inches in meter and was adjustable from a spacing of one and onehalf inch in its first or inner position to a spacing of four inches in its second or outer position by means of rod element 52 having an overall length of sixteen inches formed of three-sixteenth inch square stainless steel.

While there have been described above the principles of this invention in connection with specific apparatus, it is to be clearly understood that this description is made only by way of example and not as a limitation to the scope of the invention.

What is claimed is:

1. In a gun-type power gas burner comprising a plenum chamber having spaced front and rear walls joined by a side wall; an elongated blast tube having spaced distal and proximal ends and having a longitudinal axis, said proximal end being connected to said front wall and communicating with said plenum chamber; a blower having an air discharge duct connected to one of said walls and communicating with said plenum chamber; an elongated air-gas mixing tube coaxially disposed in said blast tube and having spaced discharge and inlet ends, said discharge end being adjacent said blast tube distal end and said inlet end extending into said plenum chamber, said mixing tube being circumferentially spaced from said blast tube to define a secondary air passage therewith, said mixing tube having an air admitting opening therein adjacent said inlet end and communicating with said plenum chamber; a gas supply line extending through one of said walls and into said inlet end of said mixing tube; and an imperforate flame spreader member spaced outwardly from said discharge end of said mixing tube and normal to said axis: the improvement wherein said flame spreader member is mounted on one end of an elongated element and comprising means for adjustably supporting the other end of said element on one of said plenum chamber walls for selective longitudinal movement of said element and flame spreader member between a first position closely spaced from said discharge end of said mixing tube and a second position spaced outwardly from said first position thereby selectively to adjust the width and length of the flame, said other end of said element extending rearwardly of said rear wall for manual adjustment of said element between said position thereof.

2. The gas burner of claim 1 wherein said element extends through said blast tube in said air passage, through said plenum chamber, and through an opening in said rear wall thereof.

3. The gas burner of claim 2 further comprising means for supporting said element adjacent said one end thereof.

4. The gas burner of claim 3 further comprising a spider member in said mixing tube adjacent said discharge end and having a plurality of radially-spaced leg portions extending outwardly to said blast tube thereby to support said discharge end of said mixing tube within said distal end of said blast tube, said last-named supporting means being mounted on one of said leg portions.

5. The gas burner of claim 4 wherein said last-named supporting means comprises a sleeve slidably embracing said element.

6. The gas burner of claim 4 wherein said element is a rod, said adjustable supporting means comprising a bushing member having a first portion seated in said opening in said rear wall of said plenum chamber and a second portion disposed on the side of said rear wall remote from said plenum chamber, said rod extending through said bushing for selective longitudinal movement therein, said second portion of said bushing having a set screw therein for retaining said rod in a selected position.

7. The gas burner of claim 6 further comprising a keeper number secured to said rear wall and engaging said second portion of said bushing.

8. The gas burner of claim 7 further comprising means on said rod intermediate said spider member and said rear wall for establishing said first and second positions of said rod and flame spreading disc.

9. The gas burner of claim 1 or claim 8 wherein said mixing tube has a Venturi throat intermediate said discharge and inlet ends, said inlet end abutting and being second to said rear wall, said inlet opening being in the sidewall of said mixing tube and facing said blower air discharge duct, said gas supply line extending through said rear wall, said flame spreading member being a disc coaxial with said axis and having a diameter generally equal to the diameter of said mixing tube at said discharge end thereof.

* * * * *

UNITED STATES PATENT AND TRADEMARK OFFICE

CERTIFICATE OF CORRECTION

PATENT NO. : 4,373,901

DATED : February 15, 1983

INVENTOR(S) : Robert A. Kaplan, Mark A. Riecke, James E. Wellman

It is certified that error appears in the above—identified patent and that said Letters Patent is hereby corrected as shown below: On the title page Correct spelling of co-inventor's name from "Reicke" to --Riecke--.

Signed and Sealed this

*Nineteenth* Day of *July 1983*

[SEAL]

*Attest:*

GERALD J. MOSSINGHOFF

*Attesting Officer*

*Commissioner of Patents and Trademarks*